United States Patent [19]

Murakami et al.

[11] 3,956,689

[45] May 11, 1976

[54] METHOD OF INSPECTING CONDITIONS OF PARTS OF ELECTRICAL IGNITION TYPE ENGINES AND APPARATUS THEREFOR

[75] Inventors: Kunihiko Murakami; Toshiaki Ogura, both of Tokyo, Japan

[73] Assignee: Banzai Jidosha Co., Ltd., Tokyo, Japan

[22] Filed: July 15, 1974

[21] Appl. No.: 488,785

[30] Foreign Application Priority Data

| | | |
|---|---|---|
| July 21, 1973 | Japan | 48-82344 |
| May 24, 1974 | Japan | 49-59163 |
| May 24, 1974 | Japan | 49-60185 |

[52] U.S. Cl. ..... 324/16 S

[51] Int. Cl.[2] ..... F02P 17/00

[58] Field of Search ..... 324/15, 16 R, 16 S; 73/116

[56] References Cited

UNITED STATES PATENTS

| | | | |
|---|---|---|---|
| 2,570,252 | 10/1951 | Lindberg, Jr. | 324/16 S |
| 2,740,069 | 3/1956 | Minto | 324/16 S |
| 3,416,630 | 12/1968 | Pohl et al. | 73/116 XR |
| 3,443,426 | 5/1969 | Austin et al. | 73/116 |

OTHER PUBLICATIONS

Heyer Dyna-Vision, Shell publication, Nov. 30, 1961, pp. 1–6.

Hirsch, Automatic Diagnosis of Engine Ailments, Electronics, May 2, 1966, pp. 70–74. 324/16R.

*Primary Examiner*—Stanley T. Krawczewicz
*Attorney, Agent, or Firm*—Flehr, Hohbach, Test et al.

[57] ABSTRACT

A method of and an apparatus for inspecting conditions of parts of electrical ignition type engines are provided wherein standard electrical waveforms representative of normal and abnormal conditions of parts of an electrical ignition type engine to be inspected are pre-recorded and an actual electrical waveform indicative of the condition of a part of the engine under operation and the corresponding one of the pre-recorded standard waveforms are displayed to permit visual comparison of them.

9 Claims, 14 Drawing Figures

METHOD OF INSPECTING CONDITIONS OF PARTS OF ELECTRICAL IGNITION TYPE ENGINES AND APPARATUS THEREFOR

BACKGROUND OF THE INVENTION

1. Field of the Invention

This invention relates to a method of and an apparatus for inspecting conditions of parts of electrical ignition type engines.

2. Description of the Prior Art

Engine-scopes have heretofore been used for the purpose of conducting adjustment or reparation of electrical ignition type engines. Such engine-scopes comprise a cathode-ray tube for visually displaying primary ignition waveforms, secondary ignition waveforms and so on, which may represent conditions of parts of engines such as the conditions of the ignition system and the conditions of mixed gas within the cylinder.

FIG. 1 of the accompanying drawings schematically illustrates the ignition system of a four-cylinder engine comprising a battery 20, an ignition coil 21, a capacitor 22, a contact 23, a distributor 24 and ignition plugs 25. The primary ignition waveform may be defined as the change in the potential difference between a point A and ground plotted with respect to time, and the secondary ignition waveform may be defined as the change in the potential difference between a point B and ground plotted with respect to time. FIG. 2(a) illustrates normal and abnormal primary ignition waveforms, and FIG. 2(b) normal and abnormal secondary ignition waveforms.

Such conventional engine-scopes require an operator who has memorized a set of normal waveforms. The operator must judge whether a waveform displayed on the engine-scope is normal or abnormal, in the light of the set of normal waveforms in his memory. Furthermore, even if he finds that the waveform is abnormal, it is very difficult for him to judge what part of the engine is defective because he would have to make many comparisons between the abnormal waveform and a number of standard abnormal waveforms before he can find one of the standard waveforms which is most similar to the displayed abnormal waveform. For this reason, only those much skilled in the art can master such conventional engine-scope.

It is an object of this invention, therefore, to provide a method of and an apparatus for inspecting conditions of parts of electrical ignition type engines which method and apparatus eliminate the above-mentioned disadvantages and permit any operator to easily, accurately and objectively judge whether an actual waveform taken from an engine is normal or abnormal.

SUMMARY OF THE INVENTION

According to an aspect of this invention, there is provided a method of inspecting conditions of parts of electrical ignition type engine wherein standard electrical waveforms representative of normal and abnormal conditions of parts of an electrical ignition type engine to be inspected are pre-recorded and an actual electrical waveform indicative of the condition of a part of the engine under operation and the corresponding one of the pre-recorded standard waveforms are displayed to permit visual comparison of them.

According to another aspect of this invention, there is provided an apparatus for inspecting conditions of parts of electrical ignition type engines comprising data recording means in which standard electrical waveforms representative of normal and abnormal conditions of parts of an engine to be inspected have been recorded, and means for displaying actual electrical waveforms from the engine under operation and the corresponding one of the standard waveforms recorded in said data recording means so as to permit visual comparison of them.

According to further aspect of this invention, a recording and reproducing device is incorporated into the body of an engine-scope, and one of standard normal primary ignition waveform, secondary ignition waveform and so on as recorded in said device and an actual electrical waveform from an engine to be inspected and under operation are alternately displayed on the cathode-ray tube of the engine-scope so that human eyes feel as if they were displayed simultaneously, thereby allowing any operator to easily find out any difference between them.

According to still further aspect of this invention, standard abnormal electrical waveforms are pre-recorded in said recording and reproducing device, and one of the pre-recorded standard abnormal waveforms and an actual waveform from an engine under operation are displayed to enable any operator to compare them and easily find out a standard abnormal waveform similar to the actual one and thus what part of the engine is defective.

According to another aspect of this invention, standard waveforms representative of conditions of parts of different type engines such as high speed type engines, high torque type engines, single-carburetor type engines and twin-carburetor type engines are pre-recorded in the recording and reproducing device so that any one of the different type engines can be easily inspected.

DESCRIPTION OF THE PREFERRED EMBODIMENTS

An embodiment of this invention will be described in connection with FIGS. 3 and 4. In this embodiment, for example, a primary ignition waveform from an engine under normal condition is pre-recorded in a recording and reproducing device, and then a primary ignition waveform from an engine of the same type under abnormal condition is displayed to be compared with the standard normal primary ignition waveform pre-recorded and reproduced in the recording and reproducing device.

Figure 1:
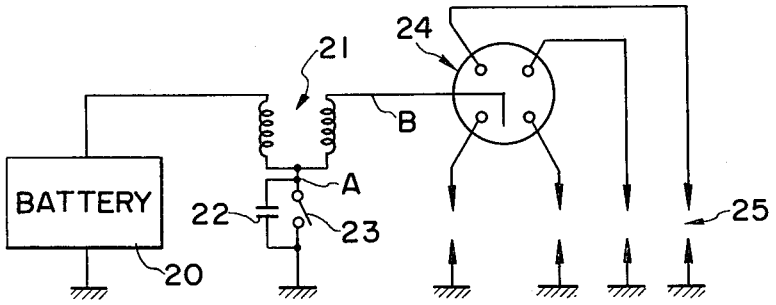
FIG. 1 is a schematic diagram of the ignition system of a four-cycle four-cylinder engine.
Figure 2:
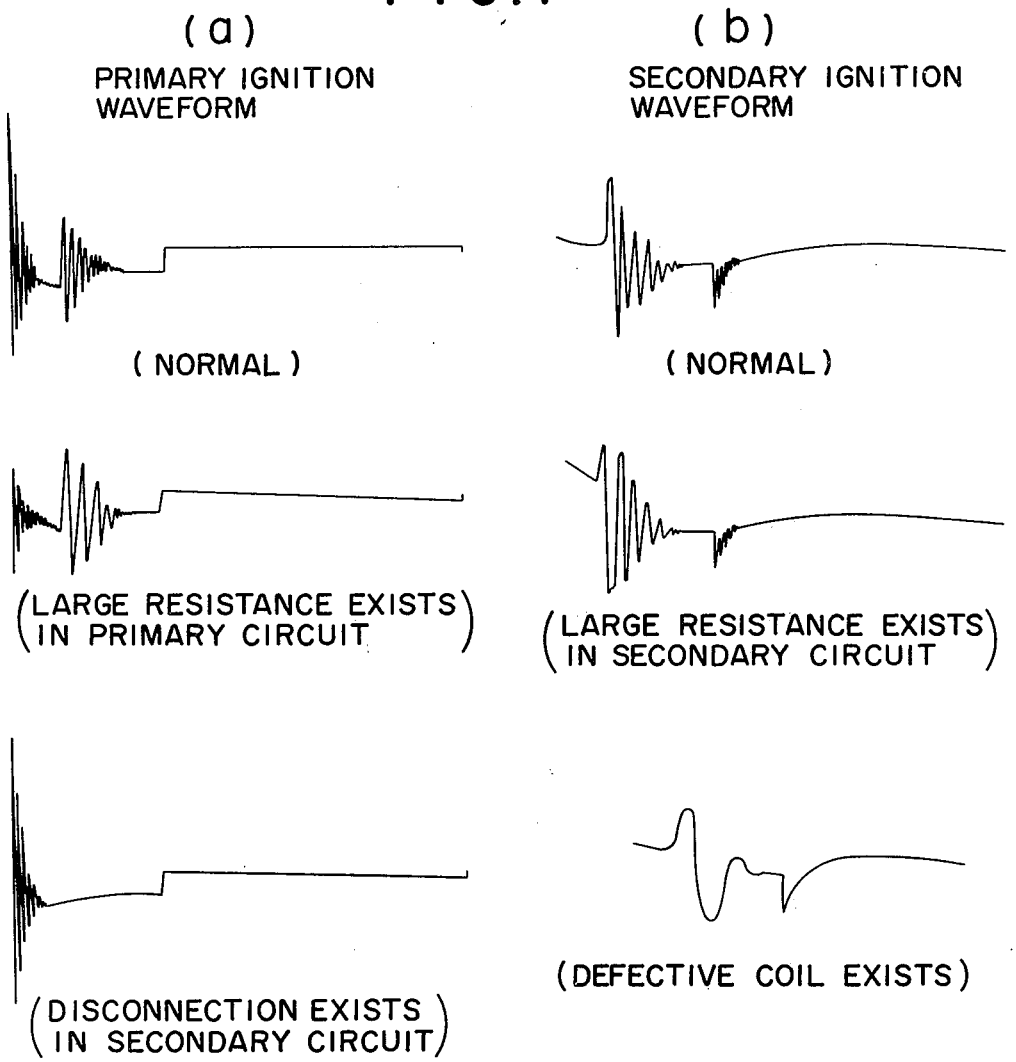
FIG. 2 illustrates different electrical waveforms from the ignition system.
Figure 3:
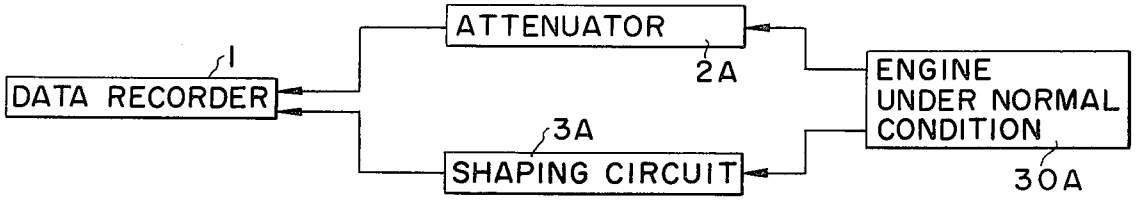
FIG. 3 is a block diagram of a system for recording standard waveforms according to one embodiment of this invention.

Referring now to FIG. 3, there is shown a block diagram of a system for recording standard normal electrical waveforms resulting from an engine under normal condition. A recording and reproducing device in this system is a two-channel simultaneous frequency modulation (FM) recording and reproducing type data recorder 1 which has a frequency range of DC to 500 KHz. The recording and reproducing device may be other suitable data memories such as core memory and magnetic disk.

A potential difference between the negative terminal of the ignition coil of an engine 30A under nornal condition and ground is attenuated by an attenuator 2A and then fed to the input terminal of the first channel of the data recorder 1. A high voltage current supplied to the ignition plug of the first cylinder of the engine 30A is converted into a pulse signal by a shaping circuit 3A and then the pulse signal is fed to the input terminal of the second channel of the data recorder 1 as a sweep initiating trigger signal. In this way, electrical signals from the engine under normal condition can be recorded.

Figure 4:
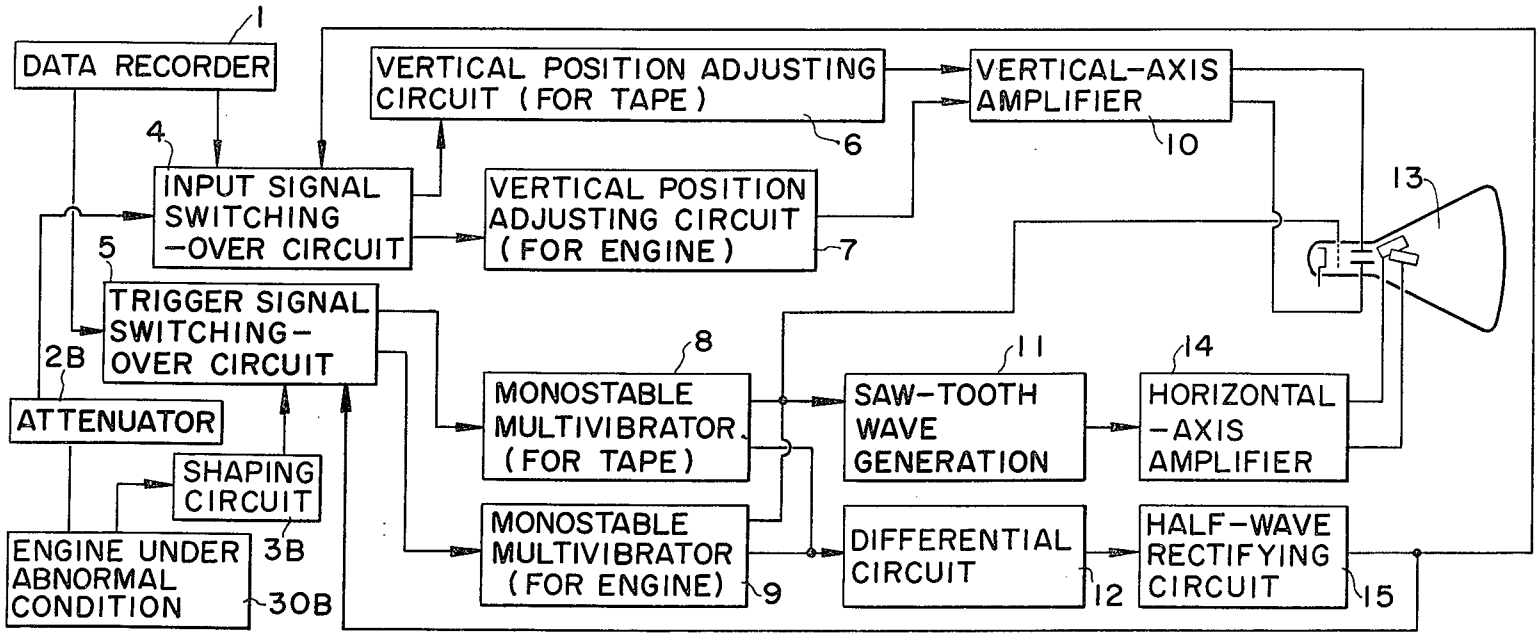
FIG. 4 is a block diagram of an apparatus for displaying standard and actual waveforms according to one embodiment of this invention.

In FIG. 4, a block diagram of a system for comparing standard and abnormal waveforms is shown. A sweep initiating trigger signal is supplied from the output terminal of the second channel of the data recorder 1 to a trigger signal switching-over circuit 5. A potential difference between the negative terminal of the ignition coil of an engine 30B under abnormal condition and ground is attenuated by an attenuator 2B and then fed to an input signal switching-over circuit 4. A high voltage current supplied to the ignition plug of the engine 30B is converted into a pulse signal by a shaping circuit 3B and the pulse signal is fed to the trigger signal switching-over circuit 5 as a sweep initiating trigger signal. The input signal switching-over circuit 4 and trigger signal switching-over circuit 5 serve as a switching circuit which controls alternate display on a cathode-ray tube 13 of signals from the data recorder 1 and the engine 30B and is responsive to sweep ending trigger signals from a half-wave rectifying circuit 15. When the input signal switching-over circuit 4 and the trigger signal switching-over circuit 5 are in a position to allow signals from the data recorder 1 to pass therethrough, primary ignition waveform signal from the data recorder 1 is fed through the input signal switching-over circuit 4 to a vertical position adjusting circuit 6 wherein the waveform signal is positively or negatively DC biased and thus display on the cathode-ray tube 13 of the waveform is vertically positioned. The biased waveform signal is amplified by a vertical axis amplifier 10 to a voltage necessary for vertical deflection in the cathode-ray tube 13. On the other hand, sweep initiating trigger signal from the data recorder 1 is applied through the trigger signal switching-over circuit 5 to a monostable multivibrator 8 as its trigger signal. The monostable multivibrator 8 is responsive to the trigger signal to produce and apply a square-wave output to a saw-tooth wave generator 11, a differential circuit 12 and the grid of the cathode-ray tube 13. The square wave supplied to the saw-tooth wave generator 11 is converted into a triangular wave and then the triangular wave is amplified to a voltage necessary for horizontal deflection in the cathode-ray tube 13 with a horizontal-axis amplifier 14. The square wave supplied to the differential circuit 12 is converted into a series of positive going impulses and negative going impulses. Only the positive going impulses of the impulse train can pass through the half-wave rectifying circuit 15. The pulses passed through the half-wave rectifying circuit 15 are fed to the input signal switching-over circuit 4 and the trigger signal switching-over circuit 5 as a horizontal sweep ending pulse to initiate switch-over of both circuits. In this position, the input signal switching-over circuit 4 and the trigger signal switching-over circuit 5 pass signals from the engine 30B and block signals from the data recorder 1. Input signal from the attenuator 2 is fed to the vertical position adjusting circuit 7 and trigger signal from the shaping circuit 3B is applied to the monostable multivibrator 9. Thus operations similar to that mentioned above are effected. The square wave supplied to the grid of the cathode-ray tube 13 is used as an unblanking signal to permit cathode rays to pass only when sweep signal is generated.

In such way as described above, signals from the data recorder 1 and the engine 30B being inspected can be alternately displayed on the cathode-ray tube 13.

Although a cathode-ray tube is used in the above embodiment, any multi-phenomenon synchroscope may be used instead.

In the above-mentioned embodiment, its sweep frequency is unchanged. Therefore, when the rotation speed of the engine changes during observation of waveforms (for its acceleration period or deceleration period), the dimensions of the displayed waveforms in the direction of horizontal axis would be changed to make accurate observation of waveform very difficult. However, by adjusting the oscillation frequency of the monostable multivibrators 8 and in FIG. 4 in accordance with the change in the rotation speed of the engine, it will be possible to held constant the time axis of waveforms displayed on the cathode-ray tube, thereby to allow easy observation of the displayed waveforms even during acceleration period of the engine.

FIGS. 5 through 10 illustrate different embodiments of this invention. According to these embodiments, an actual electrical wavefrom from an engine being inspected and under operation is displayed on an engine-scope, and a desired one of standard electrical waveforms representative of normal and abnormal conditions of an engine of the same type and pre-recorded in a data recording device is reproduced. One of the actual and standard waveforms is projected onto and reflected by a dichroic mirror and the other is transmitted through the dichroic mirror so that an observer can see the both waveforms superimposed on the dichroic mirror and can easily compare them.

Figure 5:
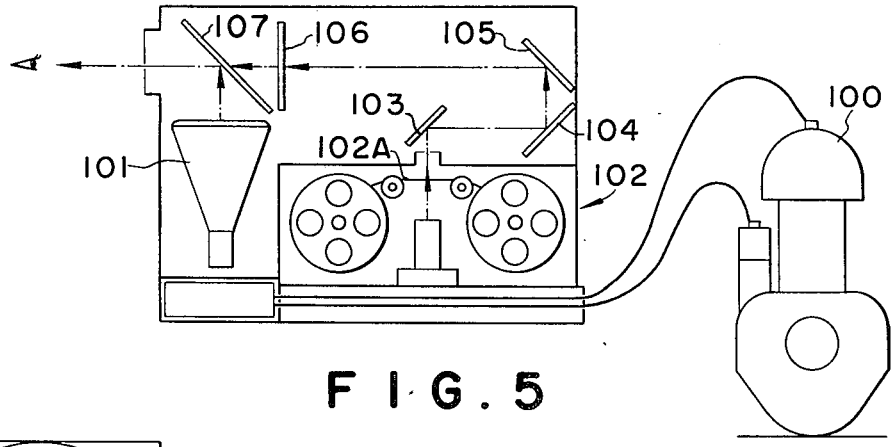
FIG. 5 is a schematic diagram of another embodiment of this invention.
Figure 6:
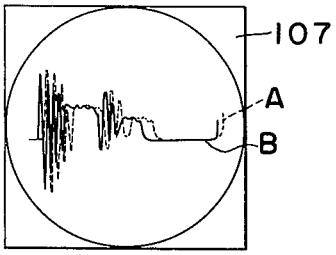
FIG. 6 is a front view of the dichroic mirror used in the embodiment of FIG. 5.

Specifically, the apparatus of FIG. 5 comprises an engine-scope 101 for displaying actual electrical waveforms from parts of an engine 100 being inspected, and a projector 102 for projecting a desired one of standard electrical waveforms representative of normal and abnormal conditions of an engine of the same type and pre-recorded on a film 102A. The actual waveform displayed on the cathode-ray tube 101 is projected onto and reflected by a dichroic mirror 107, as shown by arrow. The desired standard waveform projected by the projector 102 is projected onto the dichroic mirror 107 through mirrors 103, 104 and 105, and a screen glass 106, as shown by arrow. In this apparatus, an operator can see superimposed actual and standard waveforms A and B on the dichroic mirror 107 as shown in FIG. 6 and thus can easily compare them.

Figure 7:
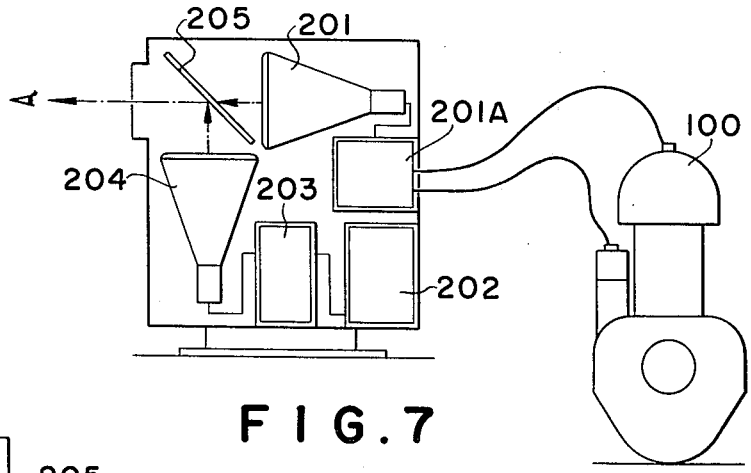
FIG. 7 is a schematic diagram of another embodiment of this invention.
Figure 8:
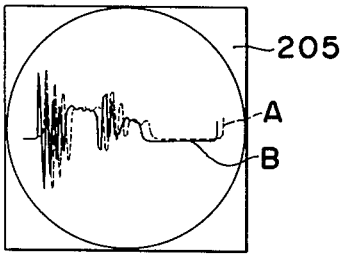
FIG. 8 is a front view of the dichroic mirror used in the embodiment of FIG. 7.

FIG. 7 illustrates a modification of the apparatus of FIG. 5. This apparatus comprises an engine-scope 201 for displaying actual electrical waveforms from parts of an engine 100 being inspected and having a shaping circuit 201A, and a tape recorder 202 for reproducing a desired one of standard electrical waveforms representative of normal and abnormal conditions of an engine of the same type and pre-recorded on a tape. The actual waveform displayed on the cathode-ray tube 201 is projected onto a dichroic mirror 205, as shown by arrow, and the desired standard waveform reproduced by the tape recorder 202 through a shaping circuit 203 and displayed on a cathode-ray tube 204 is projected onto and reflected by the dichroic mirror 205, as shown by arrow. In this apparatus, an observer can also see superimposed actual and standard waveforms A and B on the dichroic mirror 205 as shown in FIG. 8 and thus can easily compare them.

Figure 9:
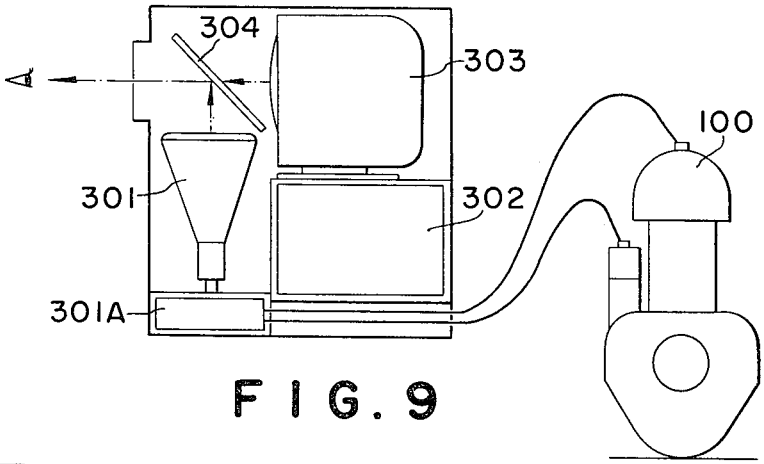
FIG. 9 is a schematic diagram of another embodiment of this invention.
Figure 10:
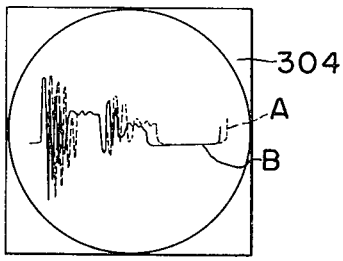
FIG. 10 is a front view of the dichroic mirror used in the embodiment of FIG. 9.

FIG. 9 illustrates another modification of the apparatus of FIG. 5. This apparatus comprises an engine-scope 301 for displaying actual electrical waveforms from parts of an engine 100 being inspected and having a shaping circuit 301A, and a video tape recorder 302 for reproducing a desired one of standard electrical waveforms representative of normal and abnormal conditions of an engine of the same type and pre-recorded on a video tape. The actual waveform displayed on the cathode-ray tube 301 is projected onto and reflected by a dichroic mirror 304, as shown by arrow, and the desired standard waveform reproduced by the video tape recorder 302 and displayed on the cathode-ray tube of a television receiver 303 is projected onto the dichroic mirror 304, as shown by arrow. According to this apparatus, an operator can also see superimposed actual and standard waveforms A and B on the dichroic mirror 304 as shown in FIG. 10 and therefore can easily compare them.

Figure 11:
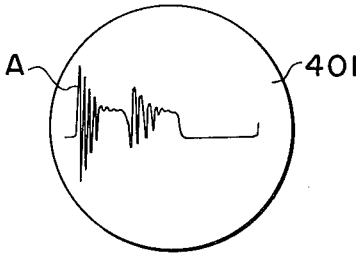
FIGS. 11 through 14 are schematic diagrams showing another embodiment of this invention.
Figure 12:
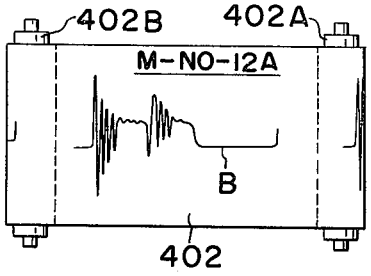
Figure 13:
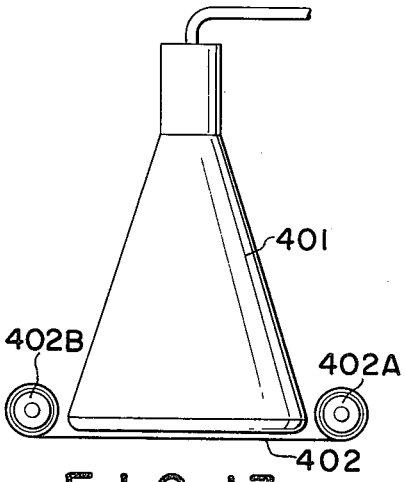
Figure 14:
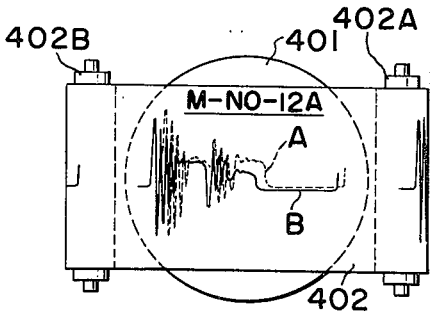

FIGS. 11 to 14 show further embodiment of this invention. In this embodiment, as shown in FIG. 11, an actual electrical waveform A from an engine to be inspected is displayed on the cathode-ray tube 401 of an engine-scope. A transparent or translucent member such as vinyl film 402 shown in FIG. 12 is provided on which standard waveforms, such as waveform B, representative of normal and abnormal conditions of an engine of the same type are pre-recorded. As shown in the plan view of FIG. 13 and the front view of FIG. 14, the vinyl film 402 is arranged to be opposite to the face plate of the cathode-ray tube 401 so that an operator can see superimposed waveforms A and B as shown in FIG. 14 and therefore can easily compare them.

In FIGS. 12, 13 and 14, reference numerals 402A and 402B indicate a take up roll and a supply roll respectively, for the vinyl film 402.

Since standard and actual waveforms are displayed on the same cathode-ray tube, dichroic mirror or the like according to this invention, any operator need not memorize a set of standard waveforms. Therefore, even those not skilled in the art can easily and accurately inspect conditions of parts of engines by means of the method or apparatus of this invention.

We claim:

1. A method of inspecting conditions of parts of electrical ignition-type engines comprising the steps of: pre-recording standard electrical waveforms representative of normal and abnormal conditions of parts of an electrical ignition type engine to be inspected; and dynamically displaying an actual electrical waveform indicative of the condition of a part of the engine under operation simultaneously with display of the corresponding one of the pre-recorded standard waveforms thereby facilitating visual comparison of them.

2. A method as defined in claim 1 wherein said actual and standard waveforms are displayed in parallel position.

3. A method as defined in claim 1 wherein said actual and standard waveforms are displayed in superimposed positions.

4. An apparatus for inspecting conditions of parts of electrical ignition type engines comprising means for pre-recording standard electrical waveforms representative of normal and abnormal conditions of parts of an electrical ignition type engine to be inspected and means for displaying an actual electrical waveform indicative of the condition of a part of the engine under operation and the corresponding one of the pre-recorded standard waveforms to permit visual comparison of them.

5. An apparatus as defined in claim 4 wherein said pre-recording means is a data recording device and said displaying means comprises a multi-phenomenon synchroscope receiving actual waveforms from said engine under operation and standard waveforms from said date recording device.

6. An apparatus as defined in claim 4 wherein said pre-recording means is a projector film and said displaying means comprises an engine-scope for displaying an actual waveform from said engine under operation, a projector for projecting a desired one of the standard waveforms recorded on said film and a dichroic mirror, whereby the actual waveform displayed on said engine-scope and the desired standard waveform projected by said projector can be superimposed on said dichroic mirror.

7. An apparatus as defined in claim 4 wherein said pre-recording means is a magnetic tape and said displaying means comprises an engine-scope for displaying an actual waveform from said engine under operation, a tape recorder for reproducing a desired one of the standard waveform recorded on said magnetic tape, a cathode-ray tube for displaying the desired waveform reproduced from said tape recorder and a dichroic mirror, whereby the actual waveform displayed on said engine-scope and the desired standard waveform displayed on said cathode-ray tube can be superimposed on said dichroic mirror.

8. An apparatus as claimed in claim 4 wherein said pre-recording means is a video tape and said displaying means comprises an engine-scope for displaying an actual waveform from said engine under operation, a video tape recorder for reproducing a desired one of the standard waveforms recorded on said video tape, a television receiver for displaying the reproduced standard waveform from said video tape recorder and a dichroic mirror, whereby the actual waveform displayed on said engine-scope and the desired standard waveform displayed on said television receiver can be superimposed on said dichroic mirror.

9. An apparatus as claimed in claim 4 wherein said pre-recording means is a transparent or translucent film and said displaying means comprises an engine-scope for displaying an actual waveform from said engine under operation and a member for moving said film across the face plate of said engine-scope so that the actual waveform on said engine-scope and a desired one of the standard waveforms recorded on said film can be superimposed.

* * * * *